US007988430B2

(12) United States Patent
Kang et al.

(10) Patent No.: US 7,988,430 B2
(45) Date of Patent: Aug. 2, 2011

(54) LINEAR COMPRESSOR

(75) Inventors: Kyoung-Seok Kang, Changwon-shi (KR); Yang-Jun Kang, Changwon-shi (KR); Min-Woo Lee, Gimhae-shi (KR); Chul-Gi Roh, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 1182 days.

(21) Appl. No.: 11/652,548

(22) Filed: Jan. 12, 2007

(65) Prior Publication Data

US 2007/0166176 A1 Jul. 19, 2007

(30) Foreign Application Priority Data

Jan. 16, 2006 (KR) ..... 10-2006-0004633
Jan. 16, 2006 (KR) ..... 10-2006-0004634

(51) Int. Cl.
*F04B 35/04* (2006.01)

(52) U.S. Cl. ..... 417/417; 417/416

(58) Field of Classification Search ..... 417/416, 417/417, 396, 397, 398, 399
See application file for complete search history.

(56) References Cited

U.S. PATENT DOCUMENTS

| | | | | |
|---|---|---|---|---|
| 5,478,220 | A * | 12/1995 | Kamitsuma et al. | 418/55.2 |
| 5,947,708 | A * | 9/1999 | Park et al. | 417/552 |
| 6,217,296 | B1 * | 4/2001 | Miyazawa et al. | 417/310 |
| 6,447,274 | B1 | 9/2002 | Horihata et al. | 418/60 |
| 6,733,723 | B2 * | 5/2004 | Choi et al. | 419/26 |
| 2003/0000376 | A1 * | 1/2003 | Sugiura et al. | 92/70 |
| 2003/0103843 | A1 * | 6/2003 | Seo | 415/110 |
| 2004/0047751 | A1 * | 3/2004 | Kim et al. | 417/417 |
| 2004/0247466 | A1 | 12/2004 | Lee et al. | 417/415 |
| 2005/0123422 | A1 * | 6/2005 | Lilie | 417/416 |
| 2005/0142007 | A1 * | 6/2005 | Lee et al. | 417/415 |
| 2008/0240961 | A1 | 10/2008 | Doi et al. | 418/66 |

FOREIGN PATENT DOCUMENTS

| | | | |
|---|---|---|---|
| CN | 1573109 | A | 2/2005 |
| CN | 1221740 | C | 10/2005 |
| JP | 09-112438 | A | 5/1997 |
| JP | 2000-002181 | | 1/2000 |
| JP | 2000-161211 | | 6/2000 |
| JP | 2005-113842 | | 4/2005 |
| JP | 2005-233142 | | 9/2005 |
| KR | 20-1999-0038971 | | 11/1999 |
| KR | 10-2002-0064838 | | 8/2002 |
| WO | WO 2005010364 | * | 2/2005 |
| WO | WO 2005010364 | A1 * | 2/2005 |
| WO | WO 2005/028867 | | 3/2005 |
| WO | WO 2005028867 | A1 * | 3/2005 |

(Continued)

OTHER PUBLICATIONS

Publication 100414081 for Laid Open Application 1019970067503, Dec. 12, 2003.*

(Continued)

*Primary Examiner* — Charles G Freay
*Assistant Examiner* — Leonard J Weinstein
(74) *Attorney, Agent, or Firm* — KED & Associates, LLP

(57) ABSTRACT

A linear compressor is provided. The linear compressor may include a cylinder in which refrigerant flows in an axial direction, a piston that reciprocates within the cylinder so as to compress the refrigerant, and a linear motor that drives the piston. At least one of the cylinder or the piston may be sintering molded.

12 Claims, 4 Drawing Sheets

FOREIGN PATENT DOCUMENTS

WO WO 2005/071269 A1 8/2005

OTHER PUBLICATIONS

Korean Patent Abstract Korean for Publication 100414081 for Laid Open Application 1019970067503, Dec. 12, 2003.*

Japanese Office Action dated Apr. 1, 2010 issued in Application No. 2007-005766.

English Text of Chinese Office Action dated Jul. 25, 2008.

Chinese Office Action issued in CN Application No. 200710001744.5 dated Mar. 29, 2011 (full Chinese text and full English translation).

* cited by examiner

【Figure 1】
Conventional Art
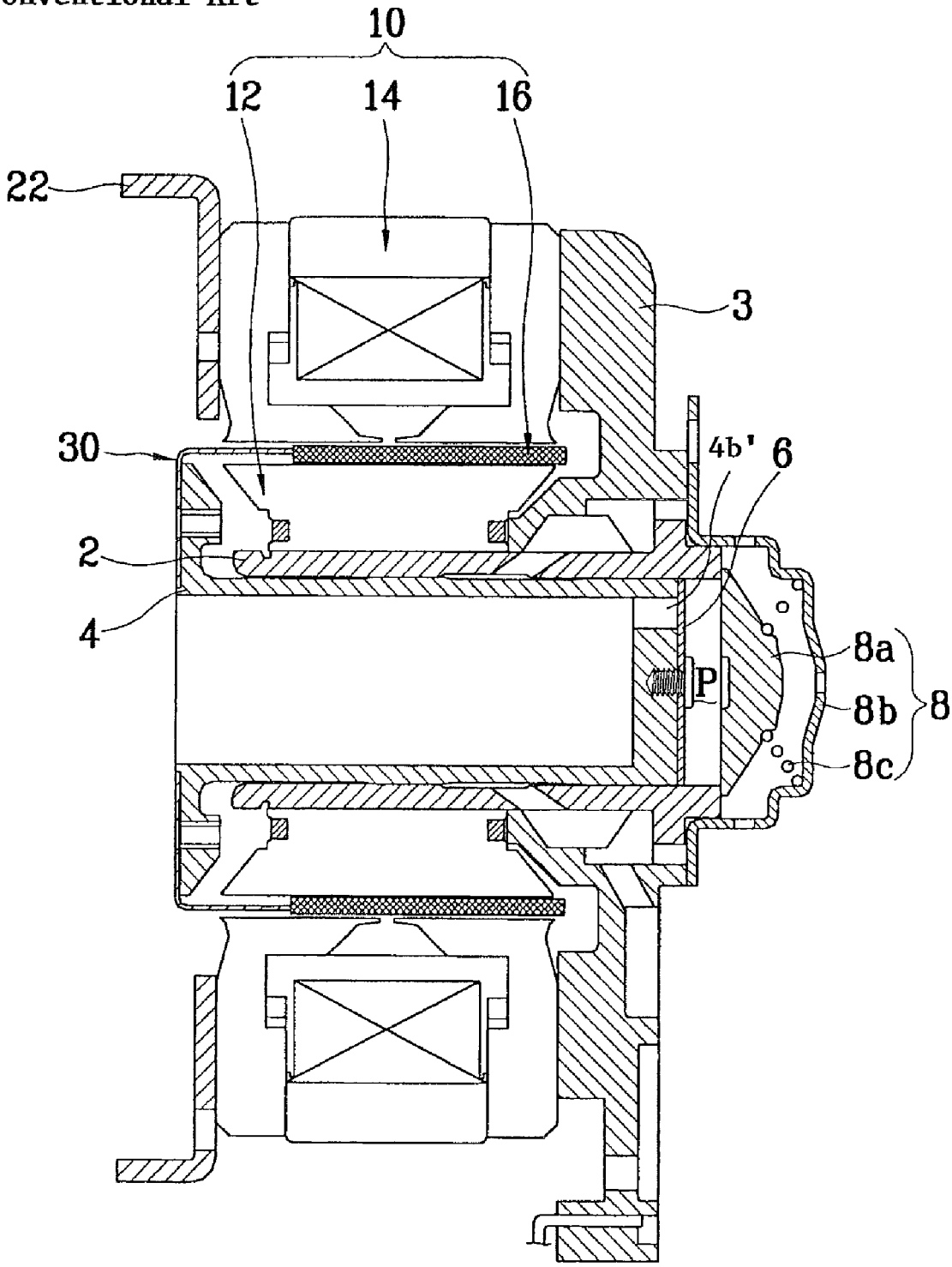

【Figure 2】
Conventional Art
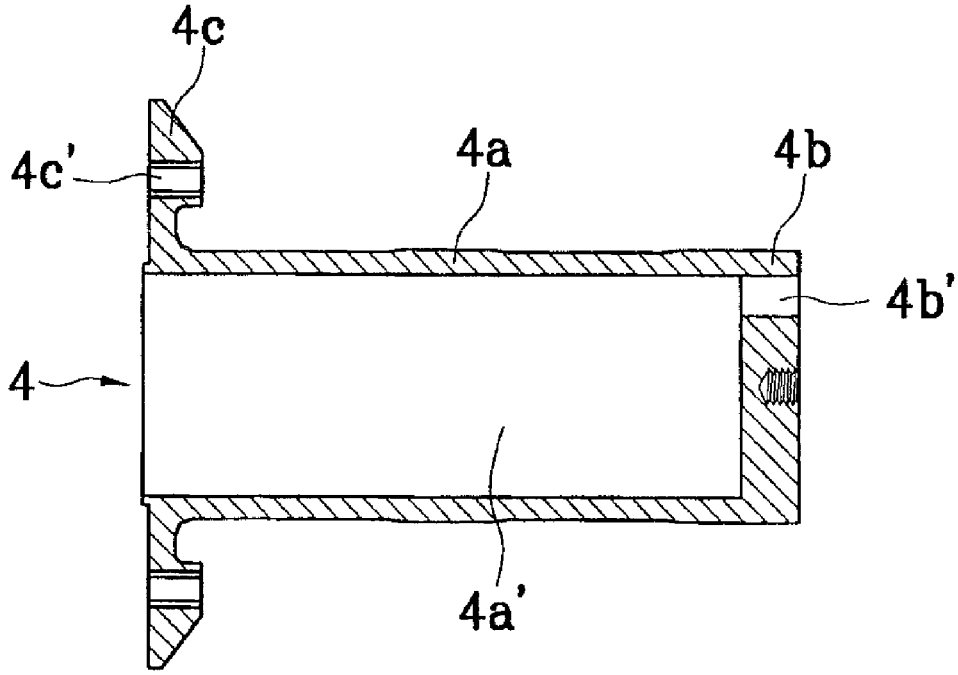
【 Figure 3】
Conventional Art
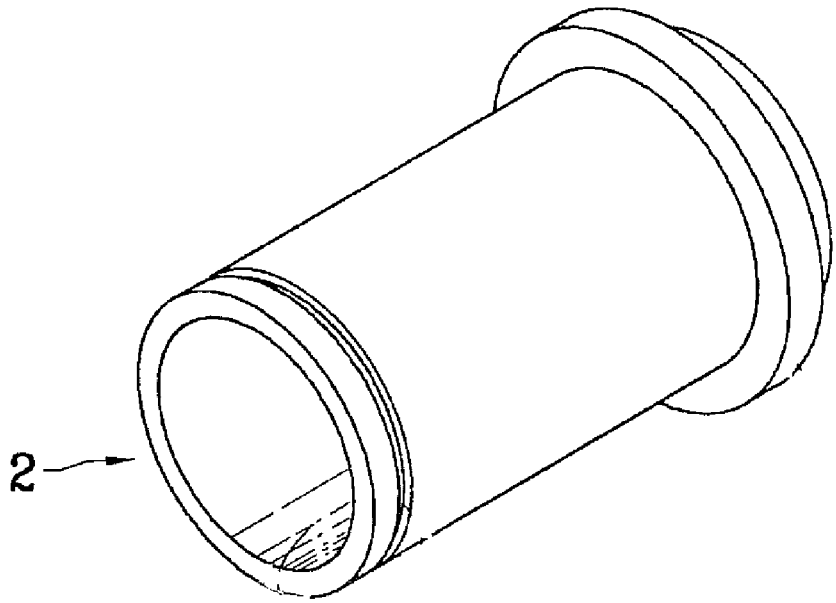

【 Figure 4】
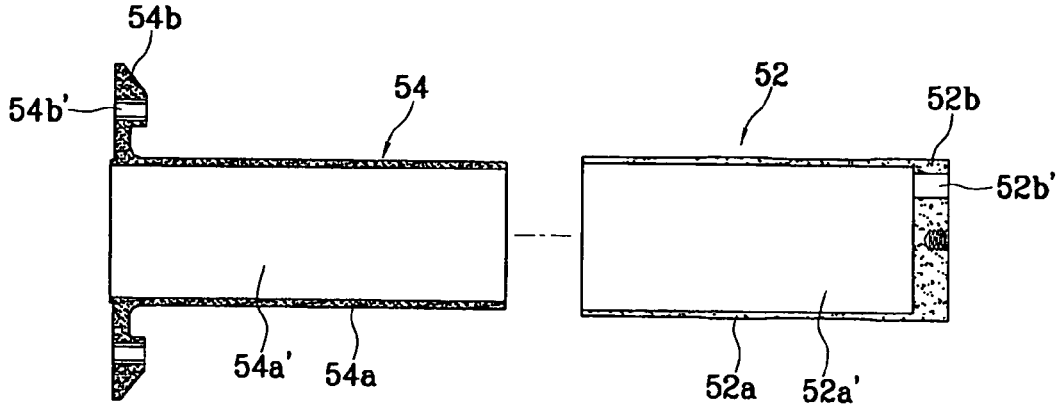
【 Figure 5】
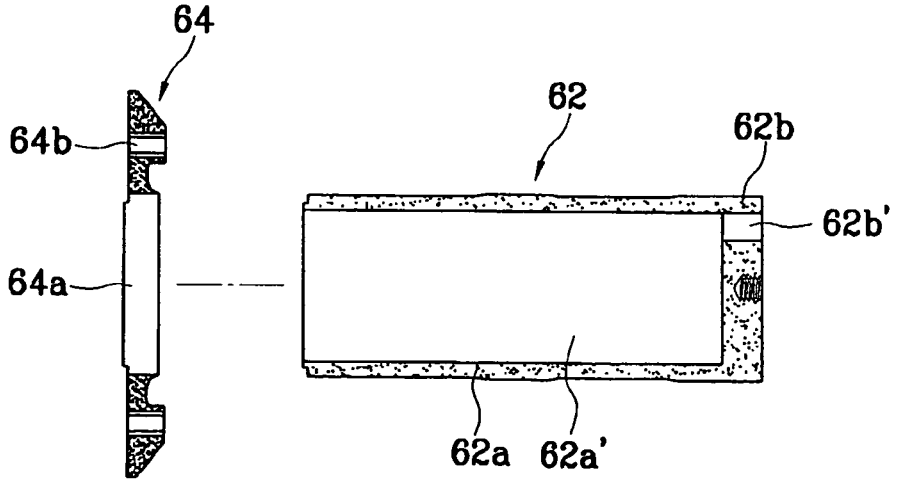

【 Figure 6】
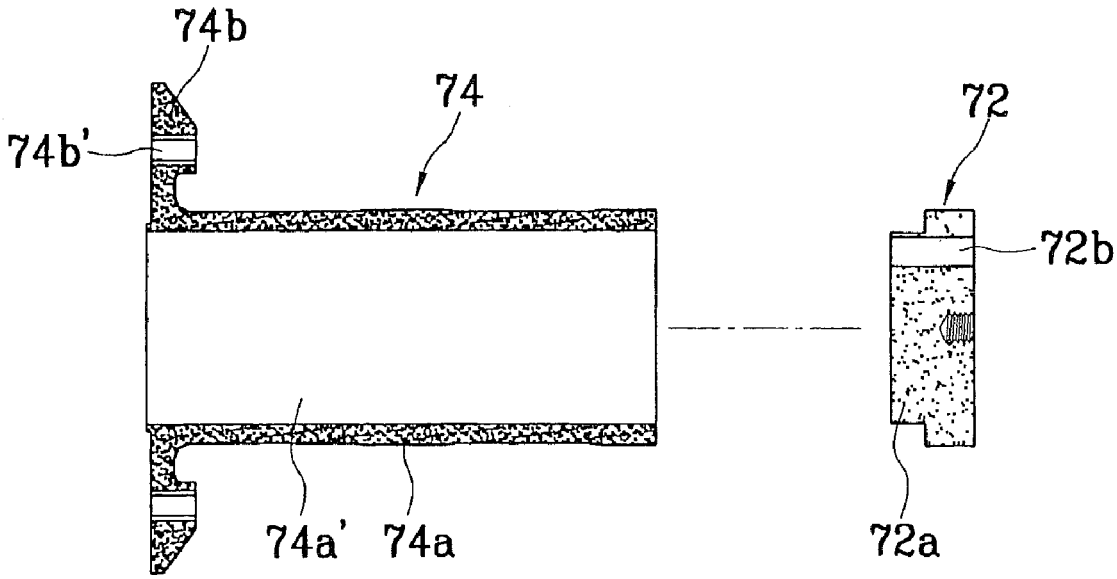
【 Figure 7】
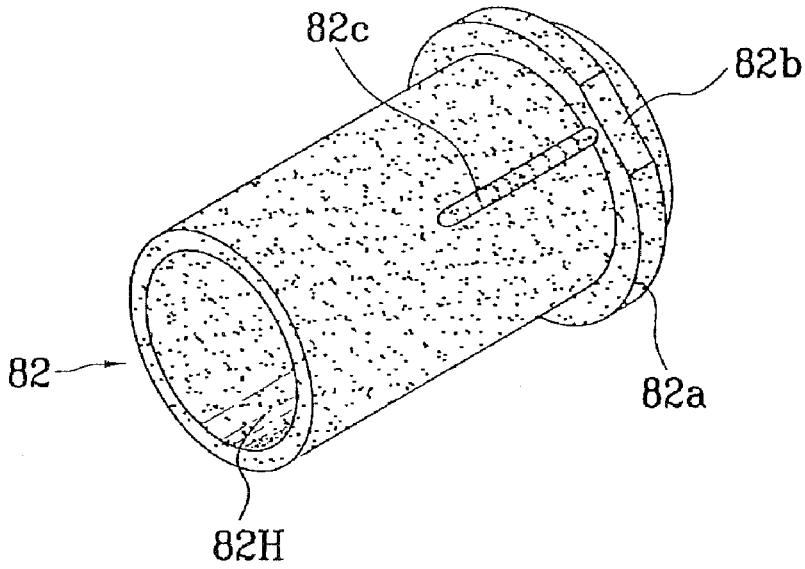

LINEAR COMPRESSOR

TECHNICAL FIELD

The present invention relates to a linear compressor with a piston linearly reciprocated inside a cylinder, for supplying refrigerants into a compression space between the piston and the cylinder, compressing the refrigerants, and discharging the refrigerants, and more particularly, to a linear compressor which can omit special mechanical processing, by molding at least one of a piston and a cylinder by using a sintering material.

BACKGROUND ART

FIG. 1 is a side-sectional view illustrating part of a conventional linear compressor, and FIG. 2 is a side-sectional view illustrating a piston of the conventional linear compressor.

Referring to FIG. 1, in the conventional linear compressor, one end of a cylinder 2 is fixedly supported by a main body frame 3 in a hermetic space inside a shell (not shown), and one end of a piston 4 is inserted into the cylinder 3. A compression space P is formed between the cylinder 2 and the piston 4. The piston 4 is connected to a linear motor 10 and reciprocated in the axial direction, for supplying refrigerants into the compression space P and discharging the refrigerants.

Here, the compression space P for compressing the refrigerants is formed between one end inner portion of the cylinder 2 and the piston 4. A communication hole 4*b*' is formed at one end of the piston 4 in the axial direction for supplying the refrigerants into the compression space P. A thin suction valve 6 for opening and closing the communication hole 4*b*' is bolt-fastened to one end of the piston 4. A discharge valve assembly 8 for discharging the refrigerants compressed in the compression space P is installed at one end of the cylinder 2.

In the discharge valve assembly 8, a discharge valve 8*a* is disposed to block one end of the cylinder 2, and a discharge cap 8*b* is fixed to one end of the cylinder 2, for temporarily storing the compressed refrigerants before externally discharging the refrigerants. The discharge valve 8*a* is elastically supported in the axial direction inside the discharge cap 8*b* by spiral discharge valve springs 8*c*.

The linear motor 10 includes a ring-shaped inner stator 12 fixed to the outer circumference of the cylinder 2 and formed by laminating a plurality of laminations in the circumferential direction, a ring-shaped outer stator 14 disposed outside the inner stator 12 with a predetermined gap, and formed by laminating a plurality of laminations in the circumferential direction outside a coil winding body formed by winding a coil in the circumferential direction, and a permanent magnet 16 disposed in a space between the inner stator 12 and the outer stator 14, and linearly reciprocated by mutual electromagnetic force of the inner stator 12 and the outer stator 14.

One end of the inner stator 12 is supported by the main body frame 3, and the other end thereof is fixed to the outer circumference of the cylinder 2 by a fixing ring (not shown). One end of the outer stator 14 is supported by the main body frame 3, and the other end thereof is supported by a special motor cover 22. The motor cover 22 is bolt-fastened to the main body frame 3. The permanent magnet 16 is connected to the other end of the piston 4 through a special connection member 30.

Accordingly, when current is applied to the outer stator 14, the permanent magnet 16 is linearly reciprocated by mutual electromagnetic force of the inner stator 12 and the outer stator 14, and the piston 4 is linearly reciprocated inside the cylinder 2. As the internal pressure of the compression space P is varied, the suction valve 6 and the discharge valve 8*a* are opened and closed, for sucking, compressing and discharging the refrigerants.

The piston 4 applied to the conventional linear compressor will now be explained with reference to FIG. 2. The piston 4 is manufactured by casting, and comprised of a cylindrical piston main body 4*a* formed long in the axial direction, a compression unit 4*b* for blocking one end of the piston main body 4*a*, and a connection unit 4*c* extended from the other end of the piston main body 4*a* to the radial direction.

A guide hole 4*a*' in which the refrigerants flow is formed in the axial direction in the piston main body 4*a*, at least one communication hole 4*b*' for guiding the refrigerants flowing along the guide hole 4*a*' to the compression space P is formed on the compression unit 4*b*, and at least one fastening hole 4*c*' to which the connection member 30 is bolt-fastened is formed on the connection unit 4*c*, for connecting the piston 4 to the permanent magnet 16 of the linear motor 10.

Normally, low cost steel is cast into the piston 4 in a larger size than a real size. Mechanical processing such as turning and polishing is carried out on the outer circumference of the piston 4, for transforming the piston 4 to the real size. In addition, an oil circulation groove for circulating the oil, and a friction unit rubbing against the inner circumference of the cylinder 2 may be formed on the piston 4. As the piston 4 is manufactured by casting, although the piston 4 rubs against the inner portion of the cylinder 2, the friction intensity can be maintained.

However, since steel is cast into the piston 4 of the conventional linear compressor, defects frequently occur. The added processing such as turning and polishing increases the processing cost. As various holes are formed by cutting, burrs are generated to seriously reduce operation efficiency.

FIG. 3 is a perspective view illustrating the cylinder of the conventional linear compressor.

Low cost steel is cast into the cylinder 2 in a larger size than a real size. Mechanical processing such as turning and polishing is carried out on the inner and outer circumferences of the cylinder 2, for transforming the cylinder 2 to the real size. Therefore, blowhole defects frequently occur during the casting, thereby increasing a fraction defective. After the outer circumference of the cylinder 2 is mechanically processed, aluminum is die-cast into the frame 3, and the frame 3 is fixed to the outer circumference of the cylinder 2. Here, the cylinder 2 is too much mechanically processed before the die-cast and fixation of the frame 3, which increases the processing cost and decreases operation efficiency.

DISCLOSURE OF THE INVENTION

The present invention is achieved to solve the above problems. An object of the present invention is to provide a linear compressor including a piston and a cylinder which can be easily manufactured in designed shapes and sizes without an additional process.

In order to achieve the above-described object of the invention, in one embodiment, there is provided a linear compressor, including: a cylinder in which refrigerants flow to the axial direction; a piston reciprocated inside the cylinder, for compressing the refrigerants; and a linear motor for driving the piston, wherein at least one of the cylinder and the piston is sintering molded. This may include sintering molding the cylinder, sintering molding the piston, and sintering molding both the cylinder and the piston.

In certain embodiments, at least part of the piston is sintering molded.

In certain embodiments, the piston includes at least two sintering molded members. The piston can include two or more members, and each of the members can be sintering molded.

In one embodiment, the piston includes a connection unit for interworking with the linear motor, a compression unit for compressing the refrigerants, and a piston main body for connecting the connection unit to the compression unit. At least one of the connection unit, the compression unit and the piston main body is sintering molded.

In this embodiment, the compression unit includes a communication hole for discharging the compressed refrigerants. The communication hole can be incorporated with the piston in the sintering of the piston. As compared with cutting molding of the communication hole, burrs are not generated and the process is simplified.

In this embodiment, the connection unit includes a fastening hole for connecting the piston to the linear motor. The fastening hole can be incorporated with the piston in the sintering of the piston. As compared with cutting molding of the fastening hole, burrs are not generated and the process is simplified.

In this embodiment, one of at least two members is inserted into the other member. For example, a first piston member is inserted into a second piston member, or the second piston member is inserted into the first piston member.

In this embodiment, at least two members are made of materials with different thermal expansion coefficients. By this configuration, the two members can be firmly stably coupled to each other by using the difference of the thermal expansion coefficients.

In another embodiments, the piston includes a connection unit for interworking with the linear motor, a compression unit for compressing the refrigerants, and a piston main body for connecting the connection unit to the compression unit. The connection unit and one part of the piston main body are sintering molded as a single body, and the compression unit and the other part of the piston main body are sintering molded as a single body.

In this embodiment, one part of the piston main body is coupled to the other part of the piston main body.

In another embodiment, the piston includes a connection unit for interworking with the linear motor, a compression unit for compressing the refrigerants, and a piston main body for connecting the connection unit to the compression unit. The compression unit and the piston main body are sintering molded as a single body.

In this embodiment, the connection unit includes a hole to which the piston main body is coupled.

In another embodiment, the piston includes a connection unit for interworking with the linear motor, a compression unit for compressing the refrigerants, and a piston main body for connecting the connection unit to the compression unit. The connection unit and the piston main body are sintering molded as a single body.

In this embodiment, the compression unit includes a step unit coupled to the piston main body.

In this embodiment, the cylinder is sintering molded.

In this embodiment, the cylinder includes a rotation restriction member for fixing the position of the cylinder. Here, the rotation restriction member can be disposed at any one of the cylinder and a flange unit explained later.

In this embodiment, the rotation restriction member is a rotation prevention unit disposed on the outer circumference of the cylinder. The rotation prevention unit can be any one of a convex unit and a concave unit formed on the outer circumference of the cylinder.

In this embodiment, the linear compressor includes a frame for fixing the cylinder. The cylinder includes a flange unit coupled to the frame.

In certain embodiments, the cylinder includes a rotation restriction member for fixing the position of the cylinder. The rotation restriction member is a straight line unit disposed at the flange unit.

In certain embodiments, a slope is formed on the outer circumference of the cylinder. By this configuration, for example, when the frame is formed on the cylinder by die-casting, it is possible to stably fix the frame to the cylinder without specially processing the frame formation part of the cylinder.

In certain embodiments, at least one of the cylinder and the piston is steam-processed after sintering molding. The steam processing generates an oxide film serving as a protection film for preventing corrosion and giving a lubrication characteristic to the piston and the cylinder.

In accordance with the present invention, in the linear compressor, even if the piston and the cylinder are designed in various shapes and sizes, they are manufactured as powder sintered bodies. The sintering molding secures more accurate shapes and sizes than the casting. Therefore, the additional processing such as polishing and turning is omitted to cut down the production cost. In addition, a complicate shape product can be easily manufactured by individually forming a few parts and thermally fit-pressing or welding the parts, which results in high operation efficiency. Furthermore, a material with high hardness and an excellent abrasion characteristic is used as the powder sintered body, thereby improving a mechanical characteristic.

BRIEF DESCRIPTION OF THE DRAWINGS

The present invention will become better understood with reference to the accompanying drawings which are given only by way of illustration and thus are not limitative of the present invention, wherein:

FIG. 1 is a side-sectional view illustrating part of a conventional linear compressor;

FIG. 2 is a side-sectional view illustrating a piston of the conventional linear compressor;

FIG. 3 is a perspective view illustrating a cylinder of the conventional linear compressor;

FIG. 4 is a disassembly side-sectional view illustrating a first example of a piston of a linear compressor in accordance with the present invention;

FIG. 5 is a disassembly side-sectional view illustrating a second example of the piston of the linear compressor in accordance with the present invention;

FIG. 6 is a disassembly side-sectional view illustrating a third example of the piston of the linear compressor in accordance with the present invention; and FIG. 7 is a perspective view illustrating a cylinder of the linear compressor in accordance with the present invention.

BEST MODE FOR CARRYING OUT THE INVENTION

A linear compressor in accordance with the preferred embodiments of the present invention will now be described in detail with reference to the accompanying drawings.

Exemplary linear compressors include a linear compressor with a piston molded by using a sintering material, a linear compressor with a cylinder molded by using a sintering material, and a linear compressor with a piston and a cylinder molded by using a sintering material. The piston and the cylinder of the linear compressor molded by using the sintering material will now be described.

FIG. 4 is a disassembly side-sectional view illustrating a first example of the piston of the linear compressor in accordance with the present invention.

Referring to FIG. 4, the first example of the piston of the linear compressor includes a first piston member 52 consisting of an outer member 52*a* of a cylindrical piston main body, a compression unit 52*b* formed to block one end of the outer member 52*a*, and a communication hole 52*b*' for discharging compressed fluid, and a second piston member 54 consisting of an inner member 54*a* of the cylindrical piston main body, and a connection unit 54*b* extended from one end of the inner member 54*a* to the radial direction. The first and second piston members 52 and 54 are manufactured as abrasion resistant powder sintered bodies with high hardness and an excellent abrasion characteristic, and coupled to each other.

The first and second piston members 52 and 54 can be individually manufactured and coupled to each other, or incorporated with each other.

Reference numerals which are not shown are identical to those of FIG. 1.

The first piston member 52 will now be explained. The outer member 52*a* of the piston main body is formed in a cylindrical shape. The compression unit 52*b* is formed in a relatively thick disk shape to resist a high pressure of the compression space P.

A guide hole 54*a*' is formed in the axial direction at the center portion, so that the inner member 54*a* of the piston main body can be fit-pressed into the outer member 52*a* of the piston main body. Fastening holes 54*b*' bolt-fastened to the connection member 30 and air holes are sintering molded on the connection unit 54*b* as a single body. Generally, a plurality of holes are formed at regular intervals in the circumferential direction of the center of the connection unit 54*b*. Some holes are used as the fastening holes 54*b*' bolt-fastened to the connection member 30, and the other holes are used as the air holes for cooling by air streams.

The manufacturing process of the first and second piston members 52 and 54 will now be explained. A binder which is a kind of adhesive is added to powder with relatively high abrasion resistance such as metal powder or ceramic powder. The resulting mixture is put into molds with the same sizes and shapes as those of the first and second piston members 52 and 54 having the holes, fixed, and heated over a predetermined temperature. The boundaries of the powder are adhered to each other, to form the first and second piston members 52 and 54.

The first and second piston members 52 and 54 can be manufactured as a single member, or individually manufactured and coupled to each other especially in a complicate shape. If the first and second piston members 52 and 54 are manufactured as the same powder sintered bodies, they can be coupled to each other by local welding such as copper welding. If the first and second piston members 52 and 54 are manufactured as different powder sintered bodies, they can be easily coupled to each other by heating fit-pressing.

For example, the second piston member 54 is manufactured as a powder sintered body with a higher thermal coefficient than the first piston member 52. In a state where the first piston member 52 is heated, the compression unit 52*b* of the first piston member 52 and the connection unit 54*b* of the second piston member 54 are disposed in the opposite directions, and the second piston member 54 is inserted into the first piston member 52. Since the first piston member 52 is expanded by heating, the inner member 54*a* of the second piston member 54 can be inserted into a fit-pressing hole 52*a*' of the first piston member 52. When the first and second piston members 52 and 54 are cooled, the first piston member 52 is contracted, so that the second piston member 54 can be fit-pressed into the first piston member 52. Even if the first and second piston members 52 and 54 are heated again, the second piston member 54 is more expanded than the first piston member 52, and thus continuously fit-pressed into the first piston member 52.

FIG. 5 is a disassembly side-sectional view illustrating a second example of the piston of the linear compressor in accordance with the present invention.

As illustrated in FIG. 5, the second example of the piston of the linear compressor includes a first piston member 62 consisting of a cylindrical piston main body 62*a*, and a compression unit 62*b* formed to block one end of the piston main body 62*a*, and a second piston member 64 having only a disk ring-shaped connection unit engaged with the outer circumference of the other end of the piston main body 62*a* and extended to the radial direction. The first and second piston members 62 and 64 are manufactured as abrasion resistant powder sintered bodies, and coupled to each other.

The first piston member 62 will now be explained. The piston main body 62*a* is formed in a cylindrical shape. The compression unit 62*b* is formed in a relatively thick disk shape to resist a high pressure of the compression space P.

A guide hole 62*a*' for guiding refrigerants to the axial direction is formed at the center portion of the piston main body 62*a*. At least one communication hole 62*b*' for supplying the refrigerants into the compression space P and/or bolt grooves for fixing the thin plate type suction valve 6 are sintering molded on the compression unit 62*b* as a single body.

An oil supply groove and a friction unit can be formed on the outer circumference of the piston main body 62*a* by additional processing.

The second piston member 64 will now be explained. A fit-pressing hole 64*a* with a smaller diameter than the outside diameter of the piston main body 62*a* is formed in the axial center, so that one opened end of the piston main body 62*a* can be fit-pressed into the fit-pressing hole 64*a*. In addition to the fit-pressing hole 64*a*, fastening holes 64*b* bolt-fastened to the connection member 30 connected to the permanent magnet 16 of the linear motor 10, and air holes are sintering molded as a single body.

Normally, a plurality of holes are formed at regular intervals in the circumferential direction of the center of the second piston member 64. Some holes are used as the fastening holes 64*b* bolt-fastened to the connection member 30, and the other holes to which bolts are not fastened are used as the air holes for cooling by air streams.

The manufacturing process of the first and second piston members 62 and 64 is identical to that of the first and second piston members 52 and 54 described above, and thus detailed explanations thereof are omitted.

If the first and second piston members 62 and 64 are manufactured as the same powder sintered bodies, they can be coupled to each other by local welding such as copper welding. If the first and second piston members 62 and 64 are manufactured as different powder sintered bodies, they can be easily coupled to each other by heating fit-pressing.

For example, the second piston member 64 is manufactured as a powder sintered body with a lower thermal coefficient than the first piston member 62. In a state where one opened end of the first piston member 62 opposite to the compression unit 62*b* is positioned to face the fit-pressing hole 64*a* of the second piston member 64, the second piston member 64 is heated. Since the second piston member 64 is expanded by heating, the opened end of the first piston member 62 can be easily inserted into the fit-pressing hole 64*a* of the second piston member 64. Even if the first and second piston members 62 and 64 are heated again, the first and second piston members 62 and 64 are cooled to keep the fit-pressing state.

FIG. 6 is a disassembly side-sectional view illustrating a third example of the piston of the linear compressor in accordance with the present invention.

As shown in FIG. 6, the third example of the piston of the linear compressor includes a first piston member 72 having a compression unit, a step unit 72*a* being protruded from the center of one surface of the first piston member 72 to the axial direction, and a second piston member 74 consisting of a cylindrical piston main body 74*a*, the step unit 72*a* of the first piston member 72 being fit-pressed into one end of the piston main body 74*a*, and a disk ring-shaped connection unit 74*b* extended from the other end of the piston main body 74*a* to the radial direction. The first and second piston members 72 and 74 are manufactured as abrasion resistant powder sintered bodies, and coupled to each other.

The first piston member 72 will now be explained. The first piston member 72 is formed in a relatively thick disk shape to resist a high pressure of the compression space P. The step unit 72*a* is protruded from the center of one surface of the first piston member 72 with a height difference, and inserted into one end of the piston main body 74*a*. At least one communication hole 72*b* for guiding the refrigerants flowing to the axial direction into the compression space P is formed at one side of the step unit 72*a*.

Here, the step unit 72*a* and the communication hole 72*b* passing through one side of the step unit 72*a* are sintering molded on one surface of the first piston member 72, and bolt grooves for fixing the thin plate type suction valve 6 are sintering molded on the other surface thereof as a single body.

The second piston member 74 will now be explained. The piston main body 74*a* is formed in a cylindrical shape. The inside diameter of the piston main body 74*a* is smaller than the diameter of the step unit 72*a*, so that the step unit 72*a* can be fit-pressed into one end of the piston main body 74*a*. The connection unit 74*b* is formed in a disk ring shape extended from one end of the piston main body 74*a* to the radial direction, and coupled to the connection member 30 connected to the permanent magnet 16 of the linear motor 10.

The piston main body 74*a* includes a guide hole 74*a*' for guiding the refrigerants to the axial direction and supplying the refrigerants to the communication hole 72*b*. The step unit 72*a* is fit-pressed into one end of the guide hole 74*a*'. In addition, an oil supply groove and a friction unit can be sintering molded on the outer circumference of the piston main body 74*a* as a single body by additional processing.

Fastening holes 74*b*' bolt-fastened to the connection member 30, and air holes are sintering molded on the connection unit 74*b* as a single body. Normally, a plurality of holes are formed at regular intervals in the circumferential direction of the center of the connection unit 74*b*. Some holes are used as the fastening holes 74*b*' bolt-fastened to the connection member 30, and the other holes to which bolts are not fastened are used as the air holes for cooling by air streams.

The manufacturing process of the first and second piston members 72 and 74 is identical to that of the first and second piston members 52 and 54 described above, and thus detailed explanations thereof are omitted.

If the first and second piston members 72 and 74 are manufactured as the same powder sintered bodies, they can be coupled to each other by local welding such as copper welding. If the first and second piston members 72 and 74 are manufactured as different powder sintered bodies, they can be easily coupled to each other by heating fit-pressing.

For example, the second piston member 74 is manufactured as a powder sintered body with a lower thermal coefficient than the first piston member 72. In a state where the step unit 72*a* of the first piston member 72 is positioned to face the opened one end of the second piston member 74 opposite to the connection unit 74*b*, the second piston member 74 is heated. Since the second piston member 74 is expanded by heating, the step unit 72*a* of the first piston member 72 can be easily inserted into the guide hole 74*a*' of the second piston member 74. Even if the first and second piston members 72 and 74 are heated again, the first and second piston members 72 and 74 keep the fit-pressing state.

FIG. 7 is a perspective view illustrating the cylinder of the linear compressor in accordance with the present invention.

As depicted in FIG. 7, the cylinder 2 of the linear compressor includes a cylindrical cylinder main body 82 into which the piston 4 is inserted to form the compression space P therebetween, and a flange unit 82*a* protruded from the outer circumference of one end of the cylinder main body 82. The cylinder 2 is manufactured as an abrasion resistant powder sintered body with high hardness and an excellent abrasion characteristic.

Reference numerals which are not shown are identical to those of FIG. 1.

A mounting hole 82H is formed with a predetermined diameter in the axial direction at the center portion of the cylinder main body 82, and engaged with the outside diameter of the piston 4. The cylinder main body 82 is formed in a cylindrical shape with a sufficient thickness to resist a high pressure of compressing the refrigerants in the compression space P. The flange unit 82*a* is formed at one end of the cylinder main body 82 into which the piston 4 is inserted, and the compression space P is formed at the other end thereof.

In addition to the flange unit 82*a*, a straight line unit 82*b* for fixing the cylinder main body 82 to the frame 3, and a rotation prevention unit 82*c* to which the inner stator 12 of the linear motor 10 for driving the piston 4 is fixed are sintering molded on the outer circumference of the cylinder main body 82 as a single body.

In detail, the flange unit 82*a* is protruded from the outer circumference of the opposite side (the other end) to one end of the cylinder main body 82 having the compression space P. Preferably, the flange unit 82*a* is formed in a disk ring shape protruded along the circumferential direction, and disposed more inwardly than the other end of the cylinder main body 82 by a predetermined interval.

The straight line unit 82*b* contacts the frame 3, and prevents the cylinder main body 82 from being rotated in regard to the frame 3. Preferably, a pair of straight line units 82*b* are formed on both surfaces of the flange unit 82*a*, by partially cutting both sides of the flange unit 82*a*. It is also possible to change the shape and number of the straight line unit 82*b*.

Especially, the flange unit 82*a* is protruded from the outer circumference of the cylinder main body 82, and operated as a kind of electric resistance causing loss of the current generated by the linear motor 10. However, as the straight line units 82*b* are formed on the flange unit 82*a*, the cylinder main body 82 and the flange unit 82*a* can be symmetrically formed and the volume of the flange unit 82*a* can be reduced, to prevent eddy current loss.

The rotation prevention unit 82*c* is formed long in the axial direction on the outer circumference of the cylinder main body 82 in the region between one end of the cylinder main body 82 and the flange unit 82*a*. A plurality of rotation prevention units 82*c* can be formed in the partial region in the axial direction or at regular intervals in the circumferential direction.

The outside diameter of the cylinder main body 82 is smaller than the inside diameter of the inner stator 12. The inner stator 12 is inserted along the axial direction from one end of the cylinder main body 82. Accordingly, the inner circumference of the inner stator 12 is engaged with the rotation prevention unit 82*c*, so that the inner stator 12 can be fixed onto the cylinder main body 82 without rotation.

To evenly distribute the support force, at least two rotation prevention units 82*c* are preferably formed in the opposite directions of the outer circumference of the cylinder main body 82. More preferably, the height of the rotation prevention units 82*c* is over a tolerance between the outside diameter of the cylinder main body 82 and the inside diameter of the inner stator 12.

In the sintering molding of the cylinder 2, a slope can be formed around the flange unit 82*a* of the cylinder main body 82 to be inclined to the flange unit 82*a*. Therefore, when aluminum is die-cast into the frame 3, the frame 3 can be fixed to the cylinder 2 without special processing. As a result, the process of processing the sides of the cylinder 2 can be omitted.

The manufacturing process of the cylinder 2 will now be explained. A binder which is a kind of adhesive is added to powder with relatively high abrasion resistance such as metal powder or ceramic powder. The resulting mixture is put into a mold with the same size and shape as those of the cylinder 2 having the flange unit 82*a*, the straight line unit 82*b* and the rotation prevention unit 82*c*, fixed, and heated over a predetermined temperature. The boundaries of the powder are adhered to each other, to form the cylinder 2.

More preferably, after the piston 4 and the cylinder 2 are partially or wholly molded by using the sintering material and heated, steam processing is carried out thereon to form an oxide film sensing as a protection film for preventing corrosion and giving a lubrication characteristic to the piston 4 and the cylinder 2.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A linear compressor, comprising:

a main body frame provided in a hermetic space formed within a shell;

a cylinder that is sintering molded, the cylinder including:

a cylinder main body;

a flange that protrudes outward from an outer circumferential surface of the cylinder main body so as to be supported by the main body frame; and a rotation restriction member provided on the outer circumferential surface of the cylinder main body, wherein the rotation restriction member comprises at least one linear flat surface extending along an outer circumferential surface of the flange, wherein the at least one linear flat surface contacts the main body frame so as to prevent the cylinder from rotating relative to the main body frame;

a piston that reciprocates within the cylinder so as to compress refrigerant flowing into the cylinder; and a linear motor, positioned at an outer circumference of the cylinder so as to drive the piston, wherein the linear motor includes:

a ring shaped inner stator positioned at the outer circumferential surface of the cylinder, wherein the rotation restriction member prevents rotation of the cylinder against the inner stator or prevents rotation of the flange against the main body frame;

a ring shaped outer stator positioned outside the inner stator; and a permanent magnet positioned between the inner and outer stator and connected to the piston.

2. The linear compressor of claim 1 wherein the piston includes:

a first piston member made of a first material; and a second piston member made of a second material, wherein a thermal expansion coefficient of the first material of the first piston member is greater than that of the second material of the second piston member, and wherein the first piston member is inserted into the second piston member so as to form the piston.

3. The linear compressor of claim 1, wherein the piston comprises:

a connection, unit that moves together with the linear motor;

a compression unit that compresses refrigerant; and a piston main body that connects the connection unit to the compression unit, wherein at least one of the connection unit, the compression unit or the piston main body is sintering molded.

4. The linear compressor of claim 3, wherein the compression unit comprises a communication hole formed therein through which compressed refrigerant is discharged.

5. The linear compressor of claim 3, wherein the connection unit comprises a fastening hole formed therein that connects the piston to the linear motor.

6. The linear compressor of claim 1, wherein the piston comprises:

a connection unit that moves together with the linear motor;

a compression unit that compresses refrigerant; and a piston main body that connects the connection unit to the compression unit, wherein the connection unit and a first part of the piston main body are sintering molded as a single body, and the compression unit and a second part of the piston main body are sintering molded as a single body.

7. The linear compressor of claim 1, wherein the piston comprises:

a connection unit that moves together with the linear motor;

a compression unit that compresses refrigerant; and a piston main body that connects the connection unit to the compression unit, wherein the compression unit and the piston main body are sintering molded as a single body.

8. The linear compressor of claim 7, wherein the connection unit comprises a hole formed therein to which the piston main body is coupled.

9. The linear compressor of claim 7, wherein the compression unit comprises a step unit coupled to the piston main body.

10. The linear compressor of claim 1, wherein the rotation restriction member extends longitudinally along the outer circumferential surface of the cylinder main body, and wherein an inner circumferential surface of the inner stator is engaged with the rotation restriction member so as to fix the inner stator onto the cylinder main body and prevent rotation of the inner stator relative to the cylinder main, body.

11. The linear compressor of claim 1, wherein the outer circumferential surfaCe of the cylinder is sloped relative to the flange.

12. The linear compressor of claim 1, wherein at least one of the cylinder or the piston is steam-processed after sintering molding.

* * * * *